United States Patent [19]

Green

[11] 4,061,963

[45] Dec. 6, 1977

[54] LOAD TAP CHANGER SYSTEM

[75] Inventor: John W. Green, New Wilmington, Pa.

[73] Assignee: Westinghouse Electric Corporation, Pittsburgh, Pa.

[21] Appl. No.: 680,632

[22] Filed: Apr. 27, 1976

[51] Int. Cl.[2] ..... H01F 29/04

[52] U.S. Cl. ..... 323/43.5 R

[58] Field of Search ..... 200/11 TC; 317/11 R, 317/11 E; 323/43.5 R; 361/2, 5, 8, 13

[56] References Cited

U.S. PATENT DOCUMENTS

| | | | |
|---|---|---|---|
| 3,395,327 | 7/1968 | Kaiser et al. | 323/43.5 R |
| 3,602,807 | 8/1971 | Prescott | 323/43.5 R |
| 3,622,867 | 11/1971 | Topper et al. | 323/43.5 R |

*Primary Examiner*—A. D. Pellinen
*Attorney, Agent, or Firm*—D. R. Lackey

[57] ABSTRACT

A load tap changer system for electrical power transformers, including protective apparatus which prevents a tap change in the event of a malfunction during a tap change cycle. The protective apparatus includes a relay and a current responsive device for operating the relay when current is flowing at a location prior to a tap change which would not have current flow during a normal tap change cycle. Current applied to the relay is maintained within the operating range of the relay by a tapped transformer operated by the tap changer drive.

7 Claims, 2 Drawing Figures

LOAD TAP CHANGER SYSTEM

BACKGROUND OF THE INVENTION

1. Field of the Invention

The invention relates in general to tap changer systems, and more specifically to load tap changer systems having protective apparatus for preventing a tap change in the event of a malfunction.

2. Description of the Prior Art

Tap changer apparatus for changing taps on a transformer winding without disconnecting the load, insolate a branch circuit of the tap changer, which branch includes a winding of a preventive autotransformer or divided reactor and the selector arm which will make the tap change. the interruption of this branch circuit is accomplished by a load switch, such as a vacuum switch, without interrupting current flow to the load through another branch circuit of the tape changer system. If the tap changer apparatus malfunctions during the tap change cycle and does not operate to isolate the branch circuit which includes the selector arm to be moved, the selector arm would be damaged if allowed to move from one contact to another. Thus, protective circuits are provided which monitor a predetermined parameter of the tap changer system and prevent a tap change in the event the monitored parameter indicates a malfunction during a tap change cycle. U.S. Pat. No. 3,622,867, which is assigned to the same assignee as the present application, discloses a load tap changer system with protective apparatus which monitors current flow at a selected point and at a selected time during a tap change cycle. In one embodiment, operation of the vacuum switch is monitored with a single current transformer just prior to movement of a selector arm, to determine if current is flowing through the vacuum switch. If current is flowing at this time, the vacuum switch failed to interrupt current flow and thus current is still flowing through the selector arm. An output of the current transformer at this time operates a protective or lock-out relay which has contacts in the tap changer drive circuit. In another embodiment, the bypass switch and the vacuum switch are both checked for proper operation by monitoring current flow through the selector are to be moved, just prior to movement thereof. If current is flowing through the selector arm, the bypass switch has failed to open the branch circuit, or the vacuum switch has failed to interrupt current flow between the two branch circuits. Two current transformers are required for this embodiment, with a single lock-out relay being responsive to the output of either. An output by a current tranformer when it is being checked just prior to movement of a selector arm, is used to operate a protective relay which has contacts in the tap changer drive circuit.

The protective or lock-out relay responsive to output current from a monitoring current transformer has a predetermined operating current range. Certain load tap changer applications operate over a tap range which may cause an exicting current through the split reactor or preventive autotransformer when operating on certain taps which will cause the secondary current of the monitoring current transformer to be outside the operating range of the protective relay.

SUMMARY OF THE INVENTION

Briefly, the present invention is a new and improved load tap changer system for changing taps on a winding of a power transformer under load. The new tap changer system includes protective apparatus which enables a single protective or lock-out relay to be used, notwithstanding an output current magnitude from current monitoring apparatus which may be outside the operating current range of the relay.

The protective apparatus includes means, such as a tapped transformer having tap selector switches connected thereto which are driven by the load tap changer drive, for automatically insuring that current applied to the protective relay, indicating a malfunction of the tap changer, will be within the operating current range of the relay, regardless of the tap range of the associated load tap changer. The output of the current transformer being monitored is connected to the protective relay via the tapped transformer and associated tap selector switches, with the tap selector switches being operated by the drive means of the tap changer system when a tap change by the load tap changer may cause a current magnitude from a monitoring current transformer outside the operating current range of the relay. The newly selected ratio of the tapped transformer provides a secondary current from the tapped transformer within the desired operating range.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
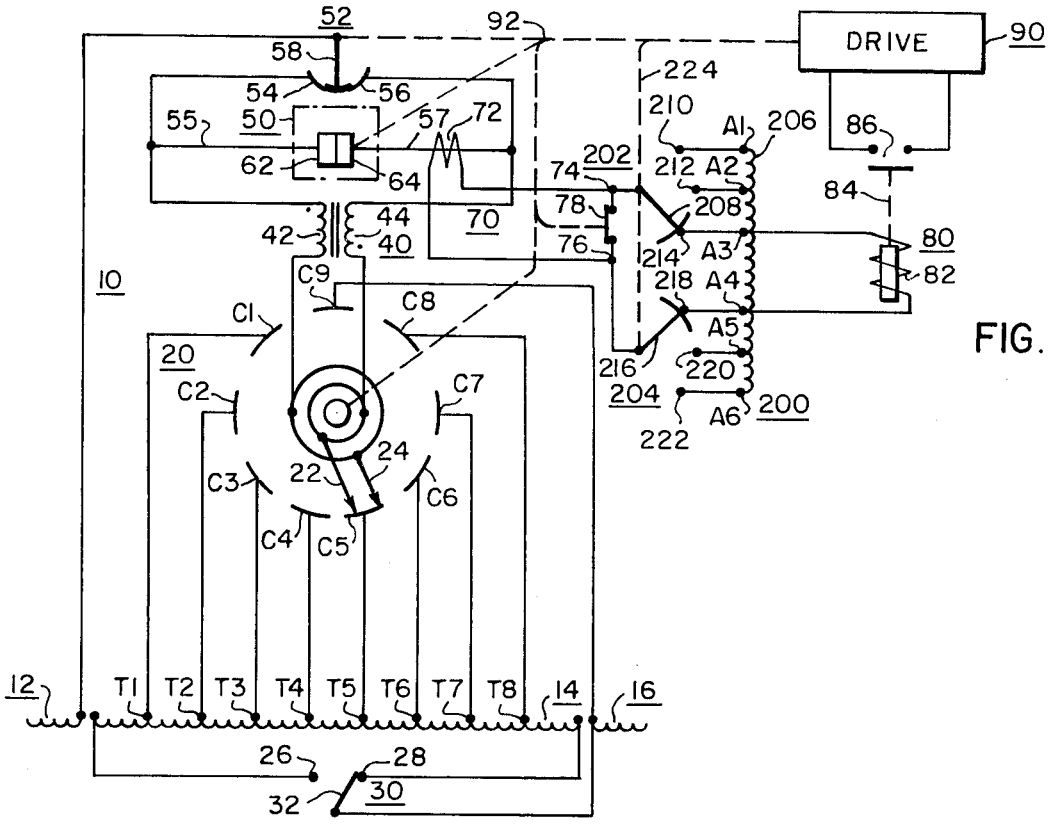
FIG. 1 is a schematic diagram of a load tap changer system constructed according to an embodiment of the invention which monitors current flow through a vacuum switch.

Referring now to the drawings, and FIG. 1 in particular, there is shown a schematic diagram of a tap changer system 10 constructed according to a first embodiment of the invention. As illustrated in FIG. 1, tap changer system 10 may be connected to windings 12, 14 and 16 of an electrical power transformer. The transformer may be a single or polyphase, and either of the autotransformer or isolated winding type, with only a portion of a single phase being illustrated in FIG. 1.

Tap changer system 10 is of the type which includes a no-load tap selector switch 20, having a plurality of stationary contacts C1 through C8 connected to taps T1 through T8, respectively, on winding 14, and a stationary contact C9 connected to winding 16. Tap selector switch 20 has a pair of movable contact arms 22 and 24 for selectively and sequentially moving between the spaced stationary contacts C1 through C9. The ends of tapped winding 14 are connected to the stationary contacts 26 and 28 of a reversing switch 30, which has a movable contact arm 32 connected to winding 16, and thus to stationary contact C9 of tap selector switch 20. The reversing switch 30 may be actuated to change its movable contact 32 from one stationary contact to the other, when one of the movable contact arms, 22 or 24, of the tap selector switch 20 is in engagement with the stationary contact C9, and the other contact arm is in transition to or from contact C9, to add the tapped voltage to, or subtract it from, the voltage of windings 12 and 14, depending upon the position of the reversing switch 30.

In order to enable the movable contact arms 22 and 24 to be connected to adjacent taps, and thus bridge a portion of winding 14, and also enable the tap changer system to operate continuously in a bridging position and obtain a voltage halfway between the voltage of two adjacent taps, the contact arms are connected to windings 12 through a split or divided reactor 40 having winding portions 42 and 44 disposed on a common magnetic core. The winding portions are wound to present a high impedance to circulating currents, while providing very little impedance to power current flow through the two winding portions.

A single, arcing duty, normally closed vacuum switch 50, and a bypass switch 52, complete the tap changer system 10, with the bypass switch 52 having first and second stationary contacts 54 and 56, and a movable contact 58. The movable contact 58 is connected to winding 12, and the stationary contacts 54 and 56 are connected to winding sections 42 and 44 of reactor 40. A movable contact 58 is arranged to engage both stationary contacts 54 and 56, or to select either of the stationary contacts individually. The vacuum switch 50 has contacts 62 and 64 disposed within an evacuated envelope, with one of the contacts being movable relative to the other, via a bellows, which maintains the vacuum seal. The vacuum switch 50 is connected across contacts 54 and 56 of the bypass switch 52, via conductors 55 and 57.

When the tap changer system 10 is in a steady state position, the power circuit of the transformer includes winding 16, the portion of winding 14 between the selected position of the reversing switch 30 and the tap or taps selected by the contact arms 22 and 24, through the two branch circuits of the contact arms. One of the branch circuits includes contact arm 24, winding section 42, and the position of the bypass switch 52 which includes stationary contact 54; and, the other branch circuit includes contact arm 22, winding section 44, and the position of bypass switch 52 which includes stationary contact 56. The branch circuits combine in the movable contact 58 of the bypass switch 52, and the power circuit continues to winding 12. Instead of having tapped winding 14 connected between two windings of the transformer, it may also be disposed at either end of a main transformer winding.

The vacuum switch 50 has its contacts closed, during normal steady state operation of the tap changer, but since it is normally shorted by the bypass switch 52, there is negligible current flow therethrough, and thus very little heating of the vacuum switch contacts.

Tap changer apparatus 10 includes protective apparatus 70 for protecting the tap selector switch 20 against operation while load current is flowing through the contact arm scheduled to move during a tap change cycle. Protective apparatus 70 includes a current transformer 72 disposed to provide a signal at its output terminals 74 and 76 responsive to current flow through the vacuum switch 50, such as by being mounted on conductor 57, as illustrated. Shorting means, such as a switch 78, is connected across the output terminals 74 and 76 of current transformer 72. In a polyphase system, monitoring current transformers from the other two phases would be connected in parallel with current transformer 72, i.e., each would be connected to terminals 74 and 76.

In the prior art, such as disclosed in the hereinbefore mentioned U.S. Pat. No. 3,622,867, a protective or lockout relay has an electromagnetic coil 82 directly connected to the output terminals 74 and 76 of current transformer 72. The present invention enables relay 80 to be used over a wide tap range, without resorting to multiple current transformers for each phase rendered effective during predetermined taps on the load tap changer, in order to cover different portions of the possible current range. Relay 80 also includes a moving core and operating mechanism 84 and a set of electrical contacts 86. The contacts 86 are connected in an electric circuit associated with the tap changer drive means 90. The tap changer drive means 90 may include a reversible electric motor and control shaft, with suitable mechanical linkages, cams, and the like, associated with the control shaft for operating the bypass switch 52, the vacuum switch 50, the contact arms of tap selector switch 20, and the electrical contacts 78, in a predetermined sequence, with the mechanical linkage between the drive means 90 and these devices being shown generally by the broken lines 92.

The contacts 86 of protective apparatus 70 are shown connected to drive means 90, and may be used to disable or stop the drive means. However, it would be equally suitable to connect contacts 86 to apparatus for deenergizing the transformer, if the application is such that deenergizing the transformer would not be detrimental to the load. As illustrated, contacts 86 are shown normally open, i.e., only when the relay 80 is not energized, but they may be normally open or normally closed, as required by the circuitry with which they are associated.

More specifically, the present invention utilizes a tapped transformer 200 and tap changer switches 202 and 204 connected thereto. Transformer 200 is preferably of the autotransformer type, having a single winding 206, but a transformer of the isolated winding type may be used. Winding 206 has a plurality of taps, with six taps A1–A6 being shown for purposes of example. Certain of the taps, such as taps A1, A2, and A3 are connected to tap changer switch 202, and certain of the taps, such as taps A4, A5 and A6 are connected to tap changer switch 204. Tap changer switches 202 and 204 may be rotary selector switches, and as illustrated in FIG. 1, the tap selector switches 202 and 204 should be of the make-before-break type to prevent a circuit interruption during a tap change on the transformer 200. Rotary switch 202 includes a movable contact arm 208 and stationary contacts 210, 212 and 214. Rotary switch 204 includes a movable contact arm 216 and stationary contacts 218, 220 and 222. To addition to the stationary contacts shown in FIG. 1, each switch may have additional stationary contacts with each of the taps A1–A6 being connected to an additional contact on the same rotary switch, to enable the switches to be operated through 360° without circuit interruption.

As illustrated in FIG. 1, the output terminals 74 and 76 of current transformer 72 are connected to the movable contact arms 208 and 216 of switches 202 and 204, respectively, and the coil 82 of relay 80 is directly connected to two of the taps, such as taps A3 and A4. However, it will be understood that the output terminals of the current transformer 72 may be directly connected to taps on the winding 206, and the coil 82 of relay 80 may be connected to the movable contact arms of the tap selector switches.

The tap selector switches 202 and 204 are responsive to the tap changer drive means 90, as indicated by broken line 224. The linkage represented by broken line 224 operates the tap selector switches in a predetermined direction when a tap change by the load tap changer 10 may provide a current magnitude at output terminals 74 and 76 of current transformer 72 which is outside of the normal operating current range of relay 80. The top selector switches 202 and 204 are operated to select a new ratio for transformer 200, which ratio will cause the current output from the transformer 200 to fall within the operating range of relay 80, notwithstanding a current output from the current transformer 72 which is outside this range. The drive means 90 will initiate a tap change on the auxiliary transformer 200 only when the tap change on the load tap changer system 10 may cause a current from the secondary winding portion of winding 206 to fall outside of the desired operating range of the relay. Thus, tap changer switches 202 and 204 will not necessarily operate each time the drive means operates the load tap changer.

In the operation of the protective apparatus 70, the switching or shorting means 78 is normally closed, preventing current transformer 72 from applying a signal to relay 80 via transformer 200, until just prior to the movement of a contact arm of tap selector switch 20 during a tap change cycle. After the bypass switch 52 has opened a predetermined branch circuit, to transfer current to the vacuum switch 50, and the vacuum switch 50 has opened to interrupt load current flow in the selected branch, shorting means 78 has its contacts opened by drive means 90. If there is no current flowing through vacuum switch 50, current transformer 72 will not provide a signal and relay 80 will not be actuated. In this instance, the tap change cycle is allowed to continue. If current is flowing through vacuum switch 50, the no-load tap selector switch 20 should not move its contact arms, and current transformer 72 will provide an output signal, actuating the relay 80. Relay 80 then actuates contacts 86, closing them in this example, which contacts are connected to stop the tap changer drive, deenergize the transformer, sound an alarm, or initiate any other desired protective function.

During a tap change cycle, the bypass switch 52 opens a preselected branch circuit, without substantial arcing, as the vacuum switch 50 is closed at this point, with the current being transferred from the opening side of the bypass switch to the vacuum switch. The vacuum switch 50 then opens its contacts to isolate the selected branch circuit, allowing the contact arm of the tap selector switch connected in that branch circuit to move to a new tap position without arcing. The vacuum switch and bypass switch then sequentially reclose to complete the tap change operation. A tap changer system of this type, and an operating mechanism for operating the vacuum switch is described in U.S. Pat. No. 3,553,395. If a move detailed step-by-step description of a complete tap change cycle is desired, the hereinbefore mentioned U.S. Pat. No. 3,622,867 may be referred to.

While the protective apparatus 70 shown in FIG. 1 will protect the tap changer switch 20 from malfunction of the vacuum switch, or its operating mechanism, it will not protect the tap selector switch from malfunction of the bypass switch 52. To protect complete protection, the protective apparatus should protect the tap selector switch against malfunction of both the bypass switch 52 and the vacuum switch 50.

Figure 2:
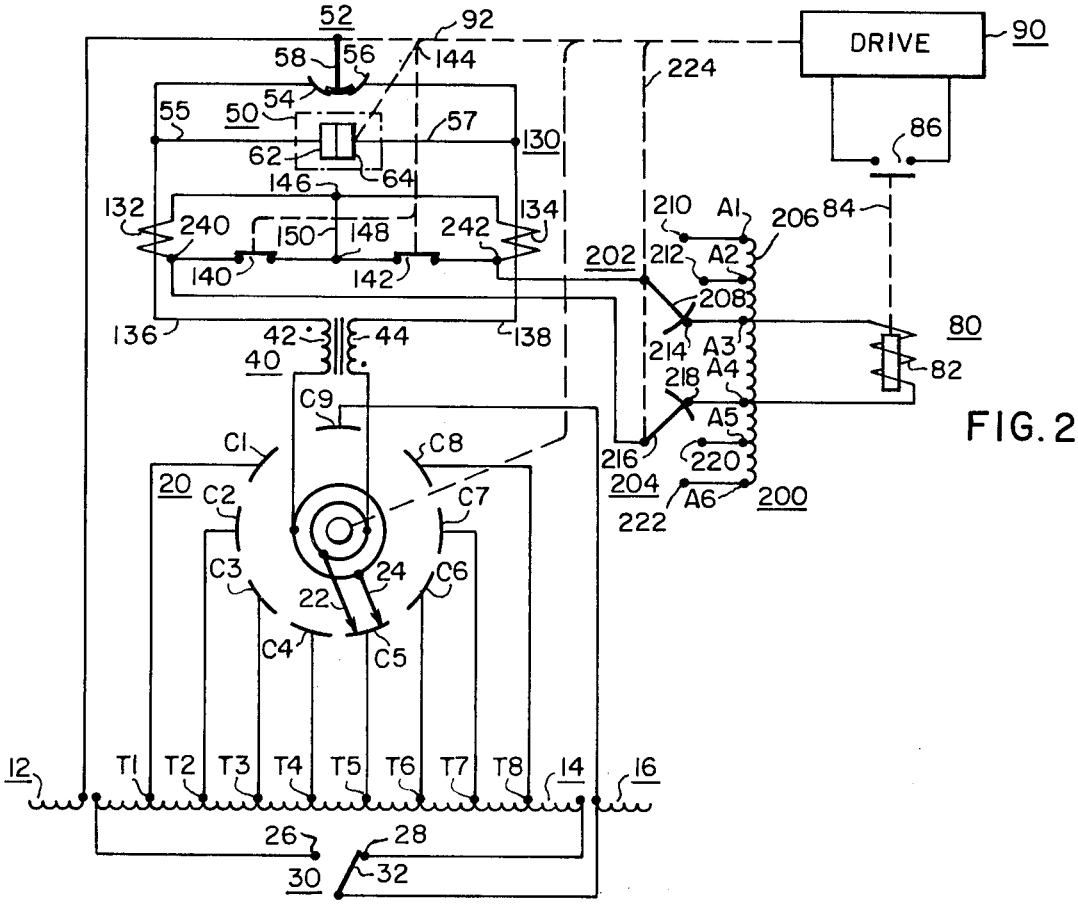
FIG. 2 is a schematic diagram of a load tap changer system constructed according to an embodiment of the invention which monitors current flow through the contact arm to be moved during a tap change cycle.

FIG. 2 illustrates the tap changer system 10 of FIG. 1, except with protective apparatus 130 constructed according to an embodiment of the invention which will provide complete protection for the tap selector switch 20. Since the tap changer system 10 is constructed and arranged in a similar manner in both FIGS. 1 and 2, like reference numerals are used in the Figures to indicate like components.

Protective apparatus 130 includes current transformers 132 and 134 disposed to provide output signals responsive to current flow through the first and second branch circuits, i.e., through the conductor 136 which interconnects conductor 55 and winding portion 42 of reactor 40, and through conductor 138 which interconnects conductor 57 and winding portion 44 of reactor 40. Shorting or switching means 140 and 142 are disposed to short the output terminals of current transformers 132 and 134, respectively, when the contacts of the shorting means are closed, with the opening and the closing of the shorting or switching means 140 being responsive to drive means 90, as illustrated generally by the broken line 144.

One end of each of the current transformers 132 and 134 is connected to a common terminal 146, and the other ends of current transformers 132 and 134 are connected together via switching means 140 and 142, which are serially connected at terminal 148, and terminals 146 and 148 are interconnected via conductor 150. In a polyphase system, the current transformers from each phase would be serially connected as shown in FIG. 2, and the serially connected current transformers from each phase would be connected to terminals 240, 146, and 242.

The switching or shorting means 140 and 142 are individually responsive to drive means 90, with switching means 140 opening during a tap change cycle just prior to movement of contact arm 24, to check the first branch circuit for current flow through contact arm 24, and with switching means 142 opening during a tap change cycle just prior to movement of contact arm 22, to check the second branch circuit for current flow through contact arm 22.

Movable contact arms 208 and 216 of tap selector switches 202 and 204 are connected across the two shorting switches 140 and 142. Contact arm 216 is connected to junction 240 between current transformer 132 and shorting switch 140, and contact arm 208 is connected to junction 242 between current transformer 134 and shorting switch 142. The operation of the tap changer apparatus shown in FIG. 2 is similar to that hereinbefore described relative to FIG. 1.

In summary, there has been disclosed a new and improved load tap changer system, which enables a single protective or lock-out relay to be utilized with the system, regardless of the tap range. The protective apparatus of the invention is interfaced with the monitoring current transformers via an auxiliary tapped transformer arrangement which is operated in response to the main drive of the load tap changer system, to automatically provide monitoring current to the protective apparatus within the range of the protective relay.

I claim as my invention:

1. A load tap changer system, comprising:

tap selector switching means having contact arms selectively movable between a plurality of electrical contacts, said plurality of electrical contacts being adapted for connection to taps on an electrical winding disposed to supply current to a load circuit, drive means for operating said tap selector switching means during a tap change cycle, means for electrically isolating each contact arm prior to movement thereof by said drive means, current transformer means disposed to measure current flow through the contact arm to be moved during a tap change cycle, prior to movement thereof by said drive means, protective means responsive to said current transformer means for preventing said drive means from moving a contact arm which has current flowing therethrough, means connected between said current transformer means and said protective means including a tapped transformer having switch means connected to said taps, said switch means being operated in response to said drive means for providing current to said protective means, when said current transformer means is providing an output, which is within the operating range of the protective means regardless of which taps on said electrical winding are connected in said load circuit.

2. The load tap changer system of claim 1 wherein the protective means includes an electromechanical relay having a contact connected to prevent the drive means from operating when said relay is energized.

3. The load tap changer system of claim 1 wherein the tap selector switching means includes first and second contact arms, the means for electrically isolating a contact arm prior to movement thereof includes reactor means having first and second windings connected to said first and second contact arms, respectively, bypass switching means having a terminal adapted for connection in the load circuit which is selectively connectable to either or both of the first and second contact arms via the associated reactor winding, and a vacuum switch connected between the ends of the first and second reactor windings which are connectable to the bypass switching means.

4. The load tap changer system of claim 3 wherein the current transformer means is a single current transformer disposed to monitor current flow through the vacuum switch prior to movement of a contact arm by the drive means.

5. The load tap changer system of claim 3 wherein the current transformer means includes first and second current transformers disposed to monitor current flow through the first and second branch circuits, respectively, prior to movement of a contact arm by the drive means, said first and second branch circuits including the first reactor winding and first contact arm, and the second reactor winding and the second contact arm, respectively.

6. The load-tap changer system of claim 1 wherein the tapped transformer is an autotransformer.

7. A load tap changer system, comprising:

tap selector switching means having contact arms selectively movable between a plurality of electrical contacts, said plurality of electrical contacts being adapted for connection to taps on an electrical winding disposed to supply current to a load circuit, drive means for operating said tap selector switching means during a tap change cycle, means for electrically isolating each contact arm prior to movement thereof by said drive means, current transformer means disposed to measure current flow through the contact arm to be moved during a tap change cycle, prior to movement thereof by said drive means, protective means responsive to said current transformer means for preventing said drive means from moving a contact arm which has current flowing therethrough, means connected between said current transformer means and said protective means including a tapped transformer and switch means connected to said taps, said switch means having make-before-break contacts, said switch means being operated in response to said drive means for providing current to said protective means, when said current transformer means is providing an output, which is within the operating range of said protective means regardless of which taps on said electrical windings are connected in said load circuit.

* * * * *